US011002090B2

(12) United States Patent
Hartl et al.

(10) Patent No.: US 11,002,090 B2
(45) Date of Patent: May 11, 2021

(54) HANDLING APPARATUS AND METHOD FOR SUPPLYING DRILL RODS

(71) Applicant: BAUER Maschinen GmbH, Schrobenhausen (DE)

(72) Inventors: Michael Hartl, Augsburg (DE); Balasaheb Dand, Schrobenhausen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 0 days.

(21) Appl. No.: 16/572,457

(22) Filed: Sep. 16, 2019

(65) Prior Publication Data

US 2021/0079741 A1 Mar. 18, 2021

(51) Int. Cl.
*E21B 19/15* (2006.01)
*E21B 19/16* (2006.01)

(52) U.S. Cl.
CPC ..... *E21B 19/155* (2013.01); *E21B 19/16* (2013.01)

(58) Field of Classification Search
CPC ..... E21B 19/155; E21B 19/15; E21B 19/14; E21B 19/16
USPC ..... 414/22.51–22.71
See application file for complete search history.

(56) References Cited

U.S. PATENT DOCUMENTS

| | | | | |
|---|---|---|---|---|
| 3,810,553 A * | 5/1974 | Crocker | E21B 19/155 414/22.61 |
| RE28,071 E * | 9/1974 | Smart | E21B 19/00 214/1 P |
| 4,067,453 A * | 1/1978 | Moller | E21B 19/155 175/85 |
| 8,052,368 B2 * | 11/2011 | Littlewood | E21B 19/14 414/22.52 |
| 8,840,352 B2 * | 9/2014 | Taggart | E21B 19/155 414/22.58 |
| 2019/0316426 A1 * | 10/2019 | Meuth | F15B 15/02 |

* cited by examiner

*Primary Examiner* — Lynn E Schwenning
(74) *Attorney, Agent, or Firm* — Studebaker & Brackett PC

(57) ABSTRACT

The invention relates to a handling apparatus and a method for supplying drill rods or casings to a drilling rig, comprising a track for receiving and supplying a drill rod or casing, a rear sledge, on which a rear end portion of the drill rod to be supplied is mounted and which can be moved along the track by means of a sledge drive arrangement, and a front sledge, on which a front end portion of the drill rod or casing to be supplied is mounted and which can be moved along the track, wherein the rear sledge and the front sledge can be releasably connected to each other by means of a linking device.

10 Claims, 14 Drawing Sheets

HANDLING APPARATUS AND METHOD FOR SUPPLYING DRILL RODS

FIELD OF THE INVENTION

The invention relates to a handling apparatus for supplying drill rods or casings to a drilling rig. Furthermore, the invention relates to a method for supplying drill rods or casings by a handling apparatus to a drilling rig.

BACKGROUND OF THE INVENTION

A generic handling apparatus and a generic method are known from U.S. Pat. No. 8,840,352 B2 for example. Such a handling apparatus comprises a receiving bed which is substantially horizontally arranged and adapted for receiving a drill rod to be supplied in a substantially horizontal position to a substantially vertical drilling rig being used for well drilling. For transferring the horizontal drilling rod an inclined supply ramp is arranged between the receiving bed and the drilling rig. By a rear sledge the drill rod is moved from the horizontal receiving bed along the supply ramp to a transfer position, at which an upper end of the drill rod can be taken by a handling element, in particular the drill drive of the vertical drilling rig.

Usually, at an upper end portion of the drill rod, outer threads are arranged for screwing together individual drill rods for providing a drill string. When pushing the drill rod along the horizontal receiving bed and particularly along the inclined ramp the fine, vulnerable outer threads can be damaged. The damaged threads can lead to malfunctions in the operation when the drill rod is connected to another drill rod by screwing.

For avoiding damaged threads, it is known to arrange a protection cap on a thread portion. Before screwing the protection cap has to be removed. Such a method is time and cost consuming and requires manual handling operations at an upper level of the drilling rig, which is undesired to safety reasons.

SUMMARY OF THE INVENTION

The invention has the object to provide a handling apparatus and a method for supplying drill rods or casings to a substantially vertical drilling rig in a particularly careful manner.

In accordance with a first aspect of the invention, the object is solved by a handling apparatus for supplying drill rods or casings to a drilling rig, comprising

- a track which is adapted for receiving and supplying a drill rod or a casing to the drilling rig,
- a rear sledge, on which a rear end portion of the drill rod or casing to be supplied is positioned and which can be moved along the track by means of a sledge drive arrangement, and
- a front sledge, on which a front end portion of the drill rod or casing to be supplied is positioned and which can be moved along the track.

According to the other aspect of the invention, the object is solved by a method for supplying drill rods or casings by a handling apparatus to a drilling rig, comprising the steps of:

- receiving a drill rod or casing to be supplied in a substantially horizontal position on a track,
- a rear end portion of the drill rod or casing to be supplied is positioned on a rear sledge, which is movable along the track,

- a front end portion of the drill rod to be supplied is positioned on a front sledge, which is movable along the track, wherein the rear sledge and the front sledge are released and distant from each other, when the rear sledge and the front sledge are moved to a transfer position at an upper end section of the track, and wherein the rear sledge and the front sledge are connected by a linking device, when the rear sledge and the front sledge are moved from a receiving position to a transfer position at an upper end section of the track, and the rear sledge and the track sledge are connected by a linking device, when the sledges are moved to the receiving position.

A basic idea of the invention is supporting the drill rod or casing on both ends when it is supplied from the track to the drilling rig. For carrying the drill rod or casing, a front sledge supporting a front end portion of the drilling rod or casing and a rear sledge for supporting a rear end portion of the drill rod or casing are provided. Both sledges are movable along the track, when the drill rod or casing is supplied to the drill drive or another handling element of the drilling rig. Consequently, by supporting or resting the drill rod or casing on both ends on the sledges an abrasive contact between the drill rod or casing and the track is avoided or significantly reduced. In particular, the thread portions at the drill rods or casings are preserved from wearing and damages during the supply operation. As a result, the following screwing operation can be carried out without or with less problems due to damaged thread portions. Any arranging or removing of protection caps at an upper level of the drilling rig or the other handling element are avoided.

The drilling rig may be vertical for a vertical drilling or have an inclined arrangement for drilling with angle of inclination against the ground, preferably an angle between 45° and 90°. The drill rods may be hollow tubes or solid bars, while the casings are hollow tubes.

According to a preferred further development of the invention, the rear sledge and the front sledge are released and distant from each other in an initial receiving position and when the rear sledge and the front sledge are moved to a transfer position at an upper end section of the track, and the rear sledge and the front sledge are connected by the linking device, when the rear sledge and the front sledge are moved from the supply ramp back to the initial receiving position. With a connecting or linking of the rear sledge and the front sledge at the upper end of the track, a preserving and reliable return movement of both sledges can be carried out.

According to another preferred embodiment of the invention, a sledge drive arrangement comprises a drive rope, which is moved along the track, and the rear sledge comprises coupling means, by which the rear sledge can be releasably coupled to the drive rope. Preferably, the drive rope extends along the track and is driven in a circulating manner by pulleys. The coupling means for coupling and decoupling the rear sledge to the drive rope can be operated by mechanical elements, for example by stopping plates or hooks. An electronic operation of the coupling means by a control unit is also possible. The front sledge may comprise a catch being in contact with the front end of the drill rod or casing. Thus, the front sledge is moved or pushed by the rear sledge via the drill rod or casing. Optionally, the front sledge is also provided with coupling means in a similar manner for driving the front sledge.

According to another further development of the invention, at the upper end of the track a stop and locking mechanism is provided, by which the front sledge is stopped and locked when reaching the stop and locking mechanism. By the stop and locking mechanism the front sledge is securely held in its upper position, until it is connected to the rear sledge by the linking device. In the upper position at least a part of the front sledge, particularly the catch, can be swung away to allow free movement of drill rod or casing over the front sledge for gripping by a handling element of the drilling rig.

According to another embodiment of the invention, the front sledge is released from the stop and locking mechanism when the rear sledge reaches the front sledge at the upper end of the track and the front sledge is connected to the rear sledge by the linking device. The rear sledge is pushed by the drive rope against the stopped front sledge. At this position, the front sledge and the rear sledge are connected to each other by the linking device and the driving of the rear sledge is stopped. This can be done by decoupling the rear sledge from the drive rope or by stopping the drive for driving the drive rope using sensors sensing the position of the sledge. The connected sledges are moved from the upper position at the track back to the receiving position by gravity or by means of the drive rope. In the later case, the moving direction of the drive rope is changed and the rear sledge is again coupled to the drive rope in case the rear sledge was decoupled.

Further, according to another embodiment of the invention, at a determined position at the track a releasing mechanism is arranged by which the linking device is disengaged and the connection between the front sledge and the rear sledge is released. In particular, the releasing mechanism is arranged at a certain middle portion of the track. In particular at this position, the front sledge is stopped, while the rear sledge is further moved back to its initial position. When both sledges have reached their initial receiving position, a new rod to be supplied can be placed on the track.

In general, the track can be one part, for example a beam, or comprise several components, preferably a substantially horizontal receiving bed and an inclined ramp. The receiving bed and the ramp may have a fixed arrangement. According to an advantageous further development of the invention, the ramp is pivotably mounted on the receiving bed. The ramp can be placed in different positions with different angles of inclination. Furthermore, for transferring the apparatus to another job site, the ramp can be pivoted onto the receiving bed for facilitating transportation.

Regarding a variant of the inventive method, at the upper end section of the ramp, the front sledge is stopped and locked by a stop and locking mechanism, when the front sledge is reaching the stop and locking mechanism. Additionally, at this position a catch of the front sledge can be swung or moved away for further pushing the drill rod or casing by the rear sledge. By the stop and locking mechanism the front sledge is securely held in its upper position, until it is connected to the rear sledge by the linking device.

In particular, it is advantageous that the front sledge is released from the stop and locking mechanism, when the rear sledge reaches the front sledge at the upper end section of the ramp and the front sledge is connected to the rear sledge by the linking device. Both connected sledges can be moved together back to their initial position at the track.

Further, at a determined position at the receiving bed of the ramp, the linking device is disengaged and the connection between the front sledge and the rear sledge is released, when the front sledge and the rear sledge are moved back from the upper end section of the track to the receiving position. When both sledges have reached their initial positions at the track, a new drill rod to be supplied to the track. After that, the method can be repeated to supply a new drill rod or casing to the drill drive of the drilling rig.

BRIEF SUMMARY OF THE DRAWINGS

In the following, the invention is described further by way of preferred embodiments illustrated schematically in the drawings, wherein show.

Figure 1:
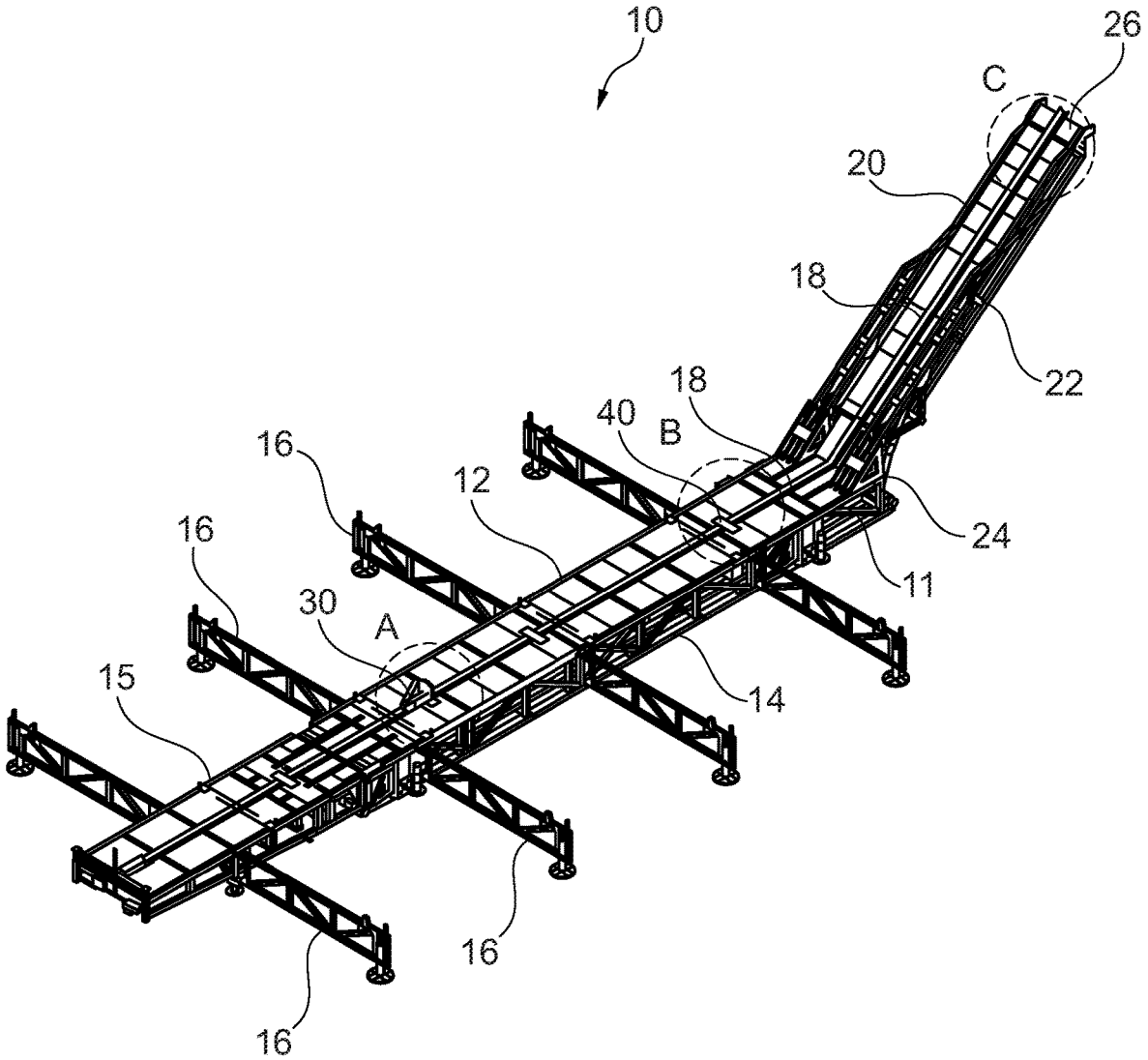
FIG. 1 a perspective view of a handling apparatus according to the invention.

An example of a handling apparatus 10 according to the invention is shown in FIG. 1.

The handling apparatus 10 comprises a track 11 having a horizontal receiving bed 12 and a supply ramp 20. The receiving bed 12 has a central main part 14 and an extension part 15 being arranged at the rear end of the main part 14. From the lateral sides of the main part 14 and the extension part 15 support legs 16 are extending horizontally. On the upper side of the support legs 16 a plurality of drill rods can be stored in parallel to the receiving bed 12.

At a front end of the main part 14 the inclined supply ramp 20 having a base part 22 is pivotably mounted by a hinge 24. At an upper end section 26 of the inclined supply ramp 20 a drilling rig is placed, which is not shown in FIG. 1. The tower-like vertical drilling rig comprises a drill drive or a handling element being adapted to grip and hold a drill rod from the supply ramp 20 and move the drill rod into a vertical operation position for rotating the drill rod for a connection to a drill string. The function of such a drilling rig with a drill drive is well known in the art and is not described further in this application.

According to the invention, a particular drill rod to be supplied to the drilling rig is arranged in the centre of the receiving bed 12 in a horizontal position. The drill rod to be supplied can be moved by a rear sledge 30 and a front sledge 40 along the horizontal receiving bed 12 and the inclined supply ramp 20 by means of a sledge drive arrangement 18. The sledge drive arrangement 18 may comprise, for example, a circularly driven drive rope, to which the rear sledge 30 and/or the front sledge 40 are releasably coupled.

Figure 2:
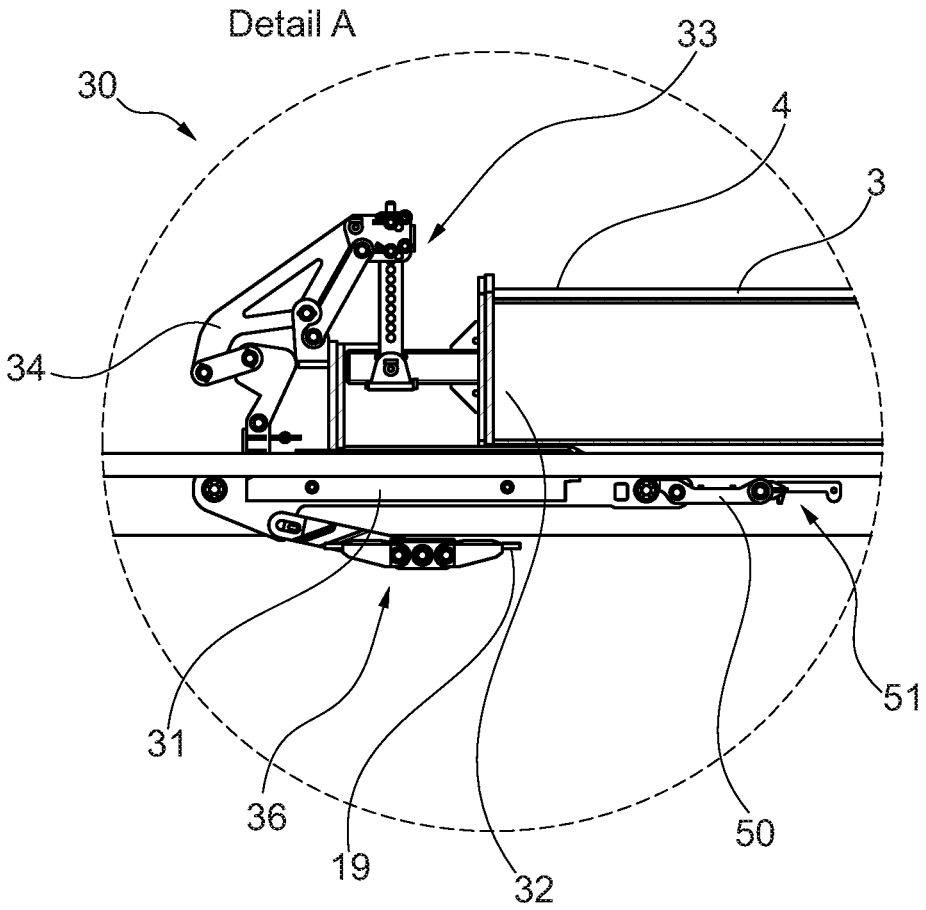
FIG. 2 an enlarged detail A of the handling apparatus of FIG. 1; showing the first sledge/rear sledge FIG. 3 an enlarged detail B of the handling apparatus of FIG. 1; showing the second sledge/front sledge FIG. 4 an enlarged detail C of the handling apparatus of FIG. 1; showing the stop and locking mechanism (simplified)

The design of the rear sledge is shown in an enlarged scale as detail A in FIG. 2.

The rear sledge 30 comprises a plate like main body 31 which is guided along a linear guiding at the receiving bed 12. A pusher plate 32 being orthogonal to the plate like main body 31 is disposed on the upper side of the main body 31. By means of an adjustment device 33 the position of the pusher plate 32 can be changed. A rear end portion 4 of a drill rod 3 is positioned on the main body 31 of the rear sledge 30 and being in pushing contact with the pusher plate 32.

On the lower side of the main body 31 of the rear sledge 30, a coupling 36 is arranged for coupling the rear sledge 30 to a drive rope 19 of the sledge drive arrangement 18. In FIG. 2 only a part of the drive rope 19 is shown. By means of a lever mechanism 34 depending on the pressure of the pusher plate 32 a clamp of the coupling 36 can be activated. Alternatively, the coupling means 36 can be activated by another component for decoupling the rear sledge 30 from the drive rope 19 when a specific position along the receiving bed or the supply ramp 20 is reached.

Furthermore, at the lower side of the main body 31 of the rear sledge 30 a first part 51 of a linking device 50 is arranged. The linking device 50 is adapted for connecting the rear sledge 30 to the front sledge 40 and will be explained later.

Figure 3:
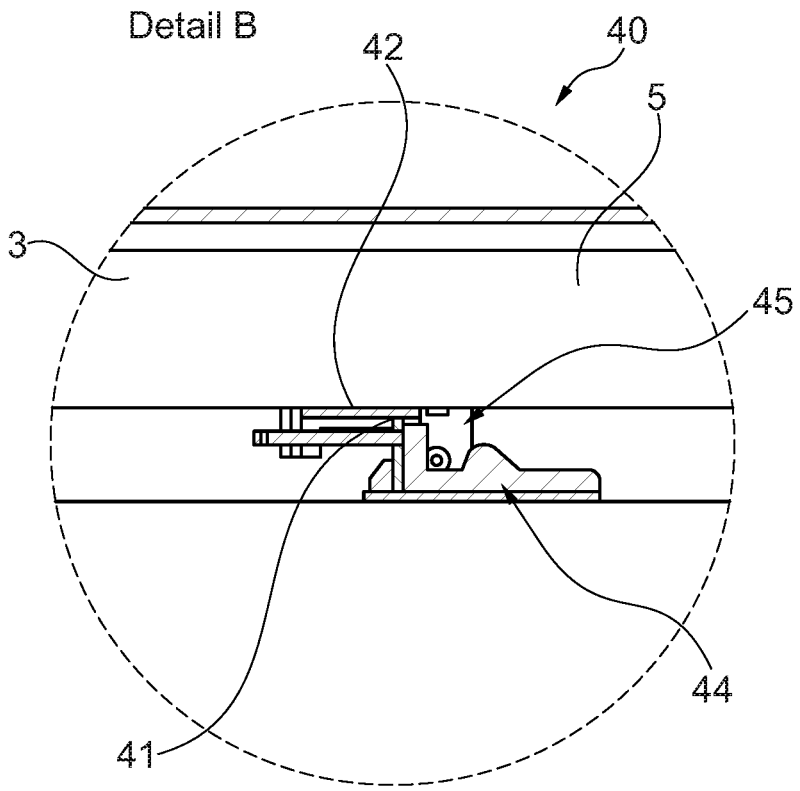

A part of the front sledge 40 is shown in greater detail in FIG. 3. On a mounting surface 42 of a base 41 of the front sledge 40 a front end portion 5 of the drill rod 3 is positioned. The front sledge 40 is also linearily guided along the guiding on the receiving bed 12, along which also the rear sledge 30 is moveably guided.

At the lower side of the base 41 of the front sledge 40, a locking device 44 with a transversely directed and moveable locking pin 45 is arranged. The locking device 44 is adapted to be engaged with a stop and locking mechanism 60 which is partly shown in FIG. 4.

Figure 4:
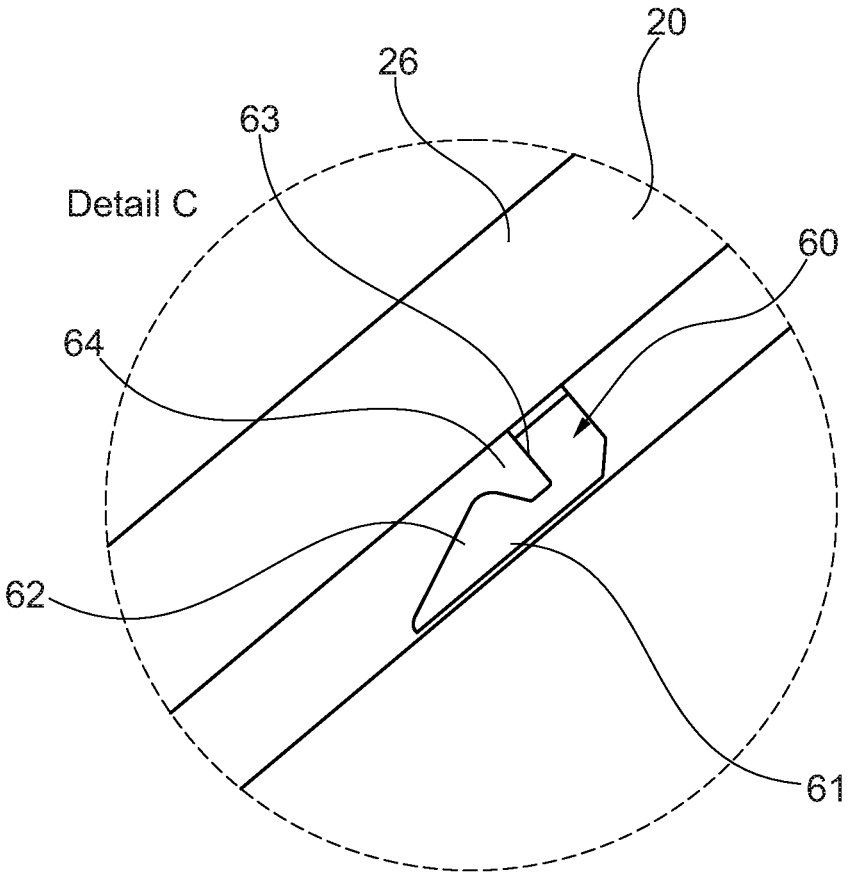

The stop and locking mechanism 60 of FIG. 4 is fixed at an upper end section 26 of the supply ramp 20. The stop and locking mechanism 60 comprises an L-shaped hook 61 which extends into the area of the recessed guiding for the rear sledge 30 and the front sledge 40. A recess 64 for receiving the locking pin 45 of the front sledge 40 is arranged between a bump 62 and a stop surface 63 extending orthogonally to a longitudinal direction of the supply ramp. When the front sledge 40 is moved against the stop and locking mechanism 60, the front sledge 40 is stopped by the stop surface 63. Simultaneously, the locking pin 45 of the front sledge 40 is pushed into and arrested in the recess 64, locking the front sledge 40 in the reached position.

Figure 5:
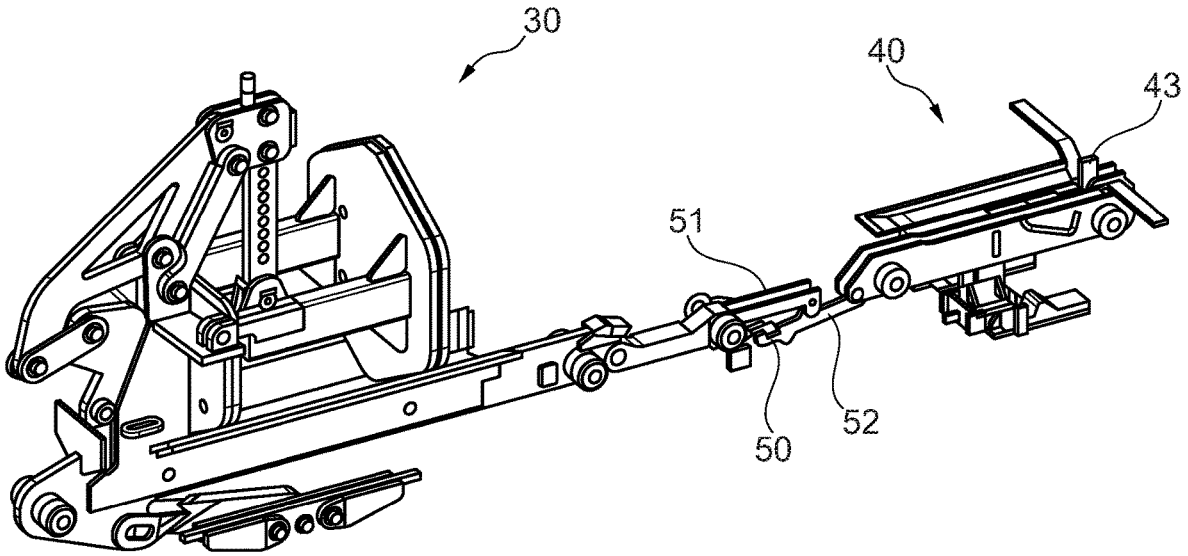
FIG. 5 a perspective view of a first sledge and a second sledge being linked together.
Figure 6:
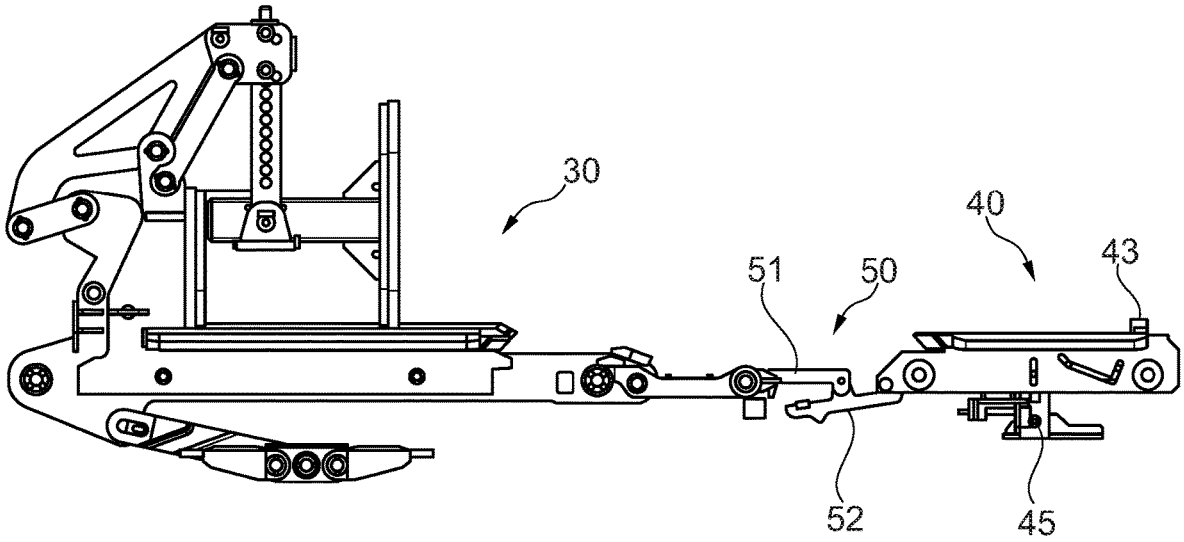
FIG. 6 a side view of the sledge arrangement of FIG. 5.

In the FIGS. 5 and 6, the rear sledge 30 and the front sledge 40 are shown when being connected or linked together by the linking device 50. At the front end of the rear sledge 40, a first part 51 of the linking device 50 is designed as a hook. When reaching the front sledge 40 stopped at the upper end section 26 of the supply ramp 20 by the stop and locking mechanism 60, the rear sledge 30 and the front sledge 40 being engaged by a second part 52 of the linking device 50. This second part 52 is also designed as a tiltable lever forming a connection between the rear sledge 30 and the front sledge 40. Furthermore, when linking the rear sledge 30 to the front sledge 40 by a lever mechanism being schematically shown, the locking pin 45 of the front sledge 40 is activated and moved out of the recess 64 of the stop and locking mechanism 60. Consequently, the rear sledge 30 and the front sledge 40 connected by the linking device 50 can be moved back down the supply ramp 20 to the receiving bed 12. This can be done by the sledge drive arrangement 18 by inverting the direction of the drive or by gravity and decoupling the rear sledge 30 from the drive rope 19.

The front sledge 40 comprises a projecting catch 43, which is in contact with the front end of the drill rod for moving the front sledge 40 via the drill rod by the driven rear sledge 30. When reaching the upper end section of the supply ramp 20, the catch 43 is retracted for allowing further movement of the drill rod.

The operation of the handling apparatus 10 according to the invention is explained in sequence steps according to the FIGS. 7 to 13.

Figure 7:
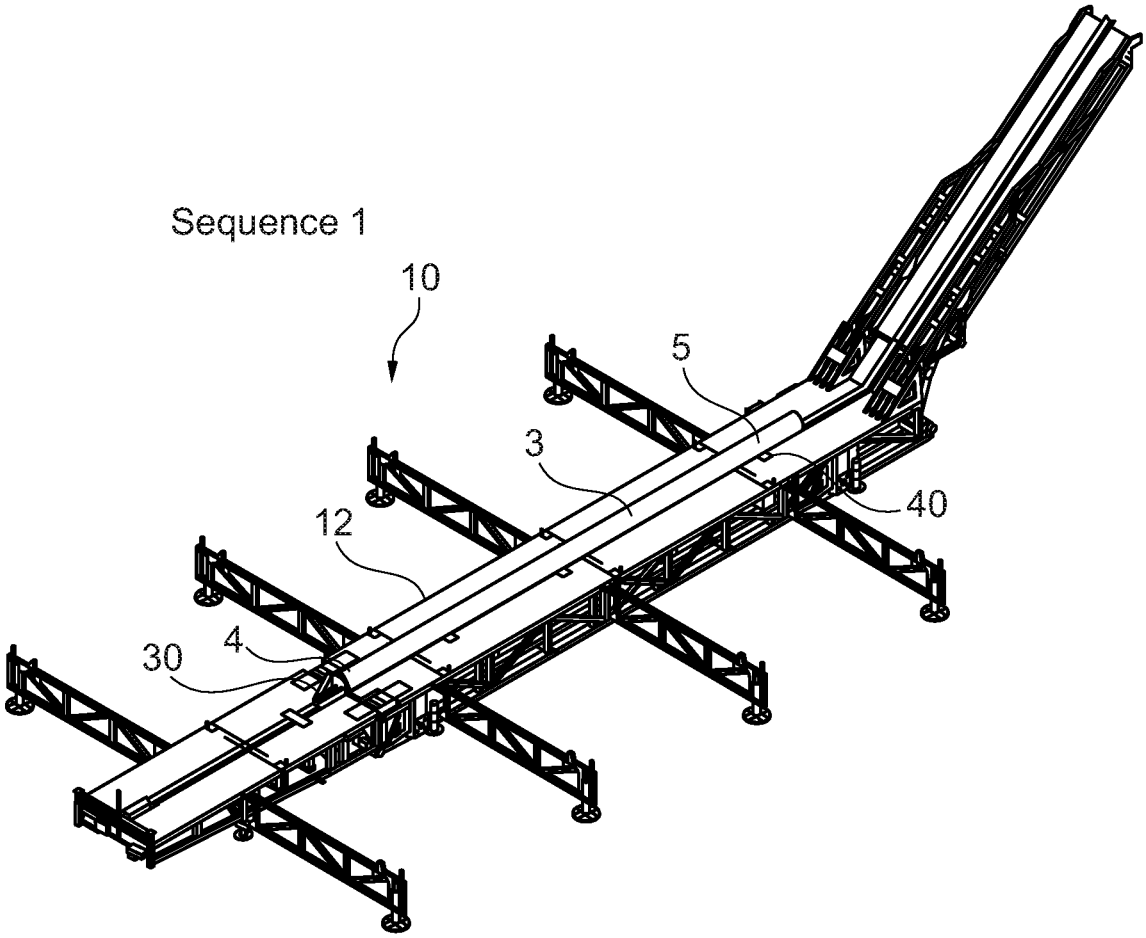
FIGS. 7 to 13 perspective views of the handling apparatus and the method for supplying drill rods according to the invention in a sequence of operation steps.

According to sequence 1 in FIG. 7, the receiving bed 12 receives in its center position a drill rod 3 in a horizontal arrangement. A rear end portion 4 of the drill rod 3 is mounted on the rear sledge 30 while a front end portion 5 of the drill rod 3 is supported by the front sledge 40. By the positioning of the drill rod 3 on the rear sledge 30 and the front sledge 40, the drill rod 3 is not in friction contact with the receiving bed 12 when the sledge drive arrangement 18 is activated.

Figure 8:
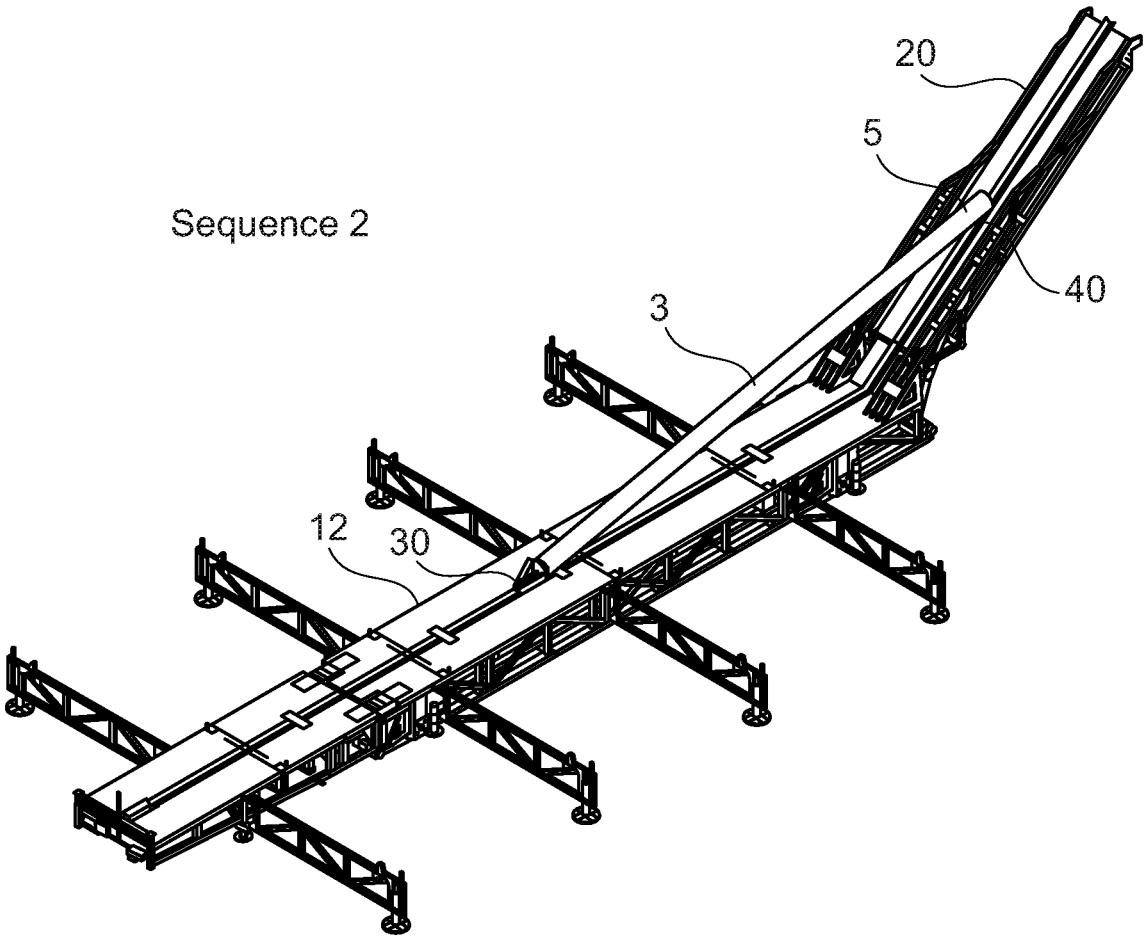

According to sequence 2 of FIG. 8, the rear sledge 30 is driven forward along the receiving bed 12 and pushing the drill rod 3 and by the drill rod 3 the front sledge 40 onto the supply ramp 20. The linear guiding of the receiving bed 12 for both sledges is continued along the supply ramp 20. It has to be emphasized that the front end portion 5 of the drill rod 3 is still resting on the front sledge 40, thereby avoiding friction and wear of a not shown thread portion at the front end portion 5 of the dill rod 3.

Figure 9:
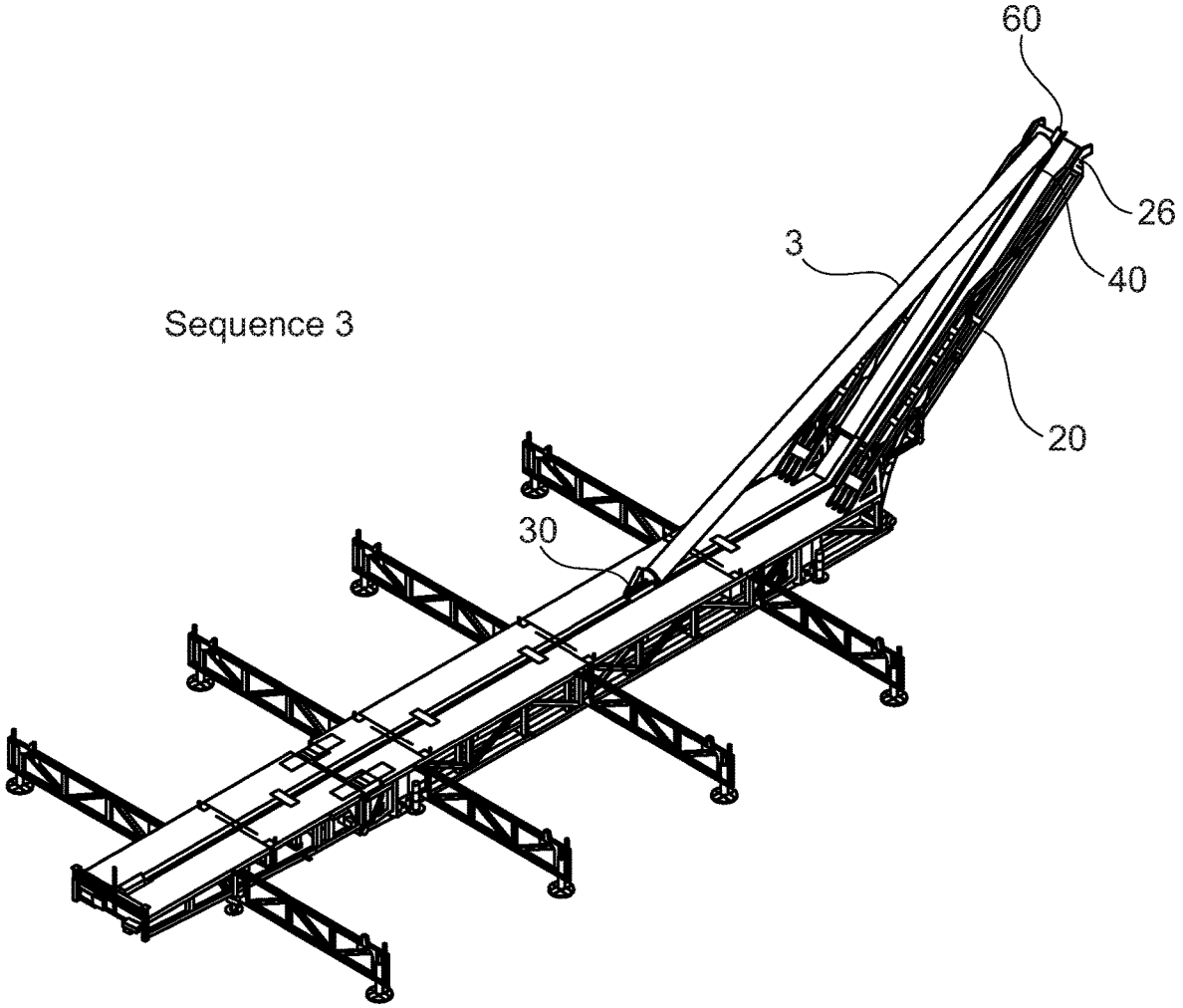

The pushing of the drill rod 3 by the rear sledge 30 onto the supply ramp 20 is continued while the front sledge 40 is stopped and locked by the stop and locking mechanism 60 at the upper end section 26 of the supply ramp 20, as shown in sequence 3 of FIG. 9. At this position the catch 43 of the front sledge 40 is retracted by a retraction mechanism.

Figure 10:
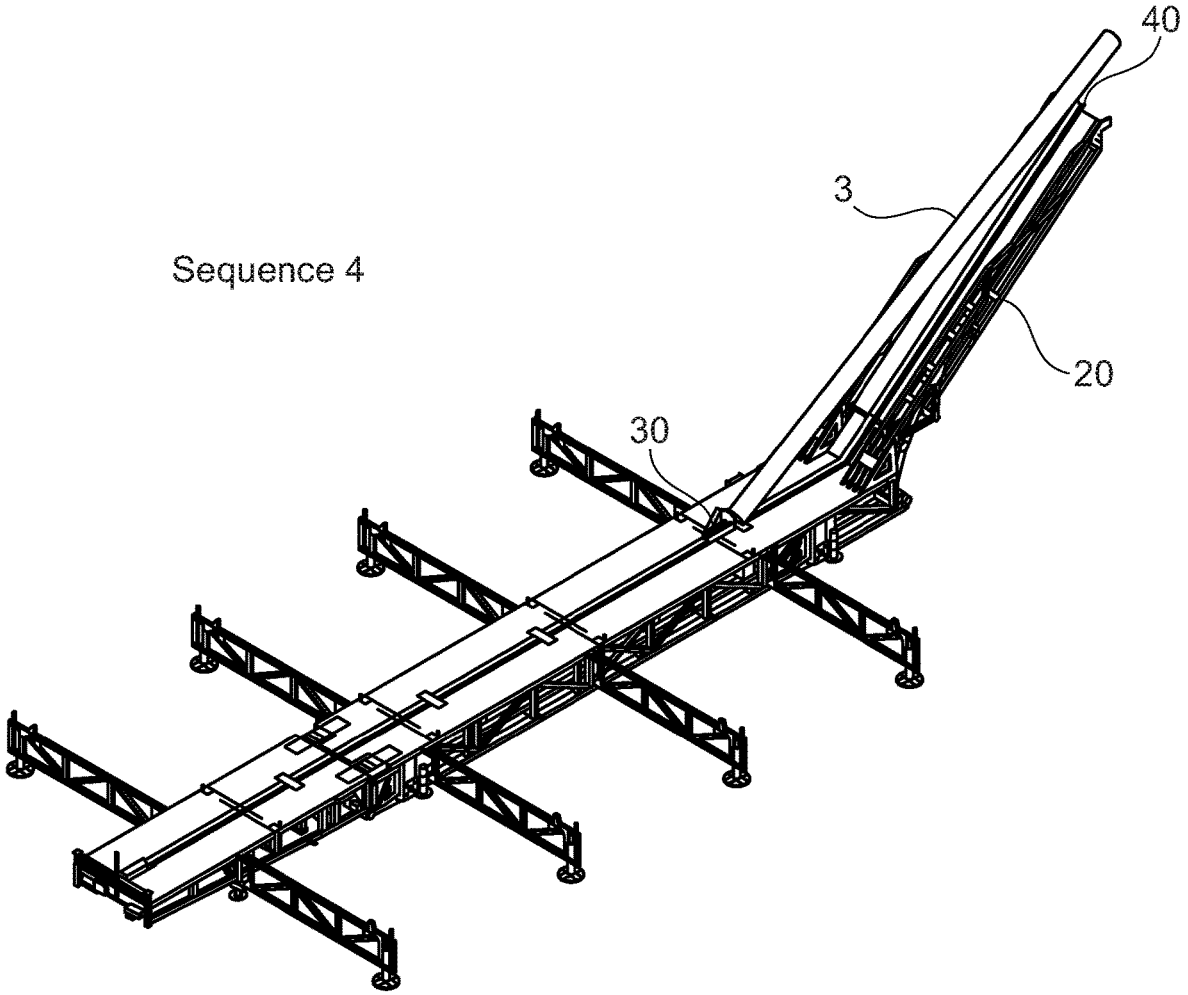

While the front sledge 40 is stopped and locked at the supply ramp 20, the drill rod 3 is still pushed further by the rear sledge 30 onto the supply ramp 20 as is shown in sequence 4 according to FIG. 10. It has to be noticed that in this sequence, the drill rod 3 is pushed over the stopped front sledge 40 and certain wear could arise at this step of operation. However, this friction and wear occurs only at an outer part of the drill rod 3 which is not equipped with a thread portion and thus this kind of wear is not significant.

When the dill rod 3 has reached its transfer position at the supply ramp 20, it is gripped by a handling element of a vertical drilling rig, being not shown in the figures. By the handling element the drill rod 3 is drawn from the supply ramp 20 into a vertical position of operation, in which the drill rod 3 is connected to a drill string, for example for well drilling.

Figure 11:
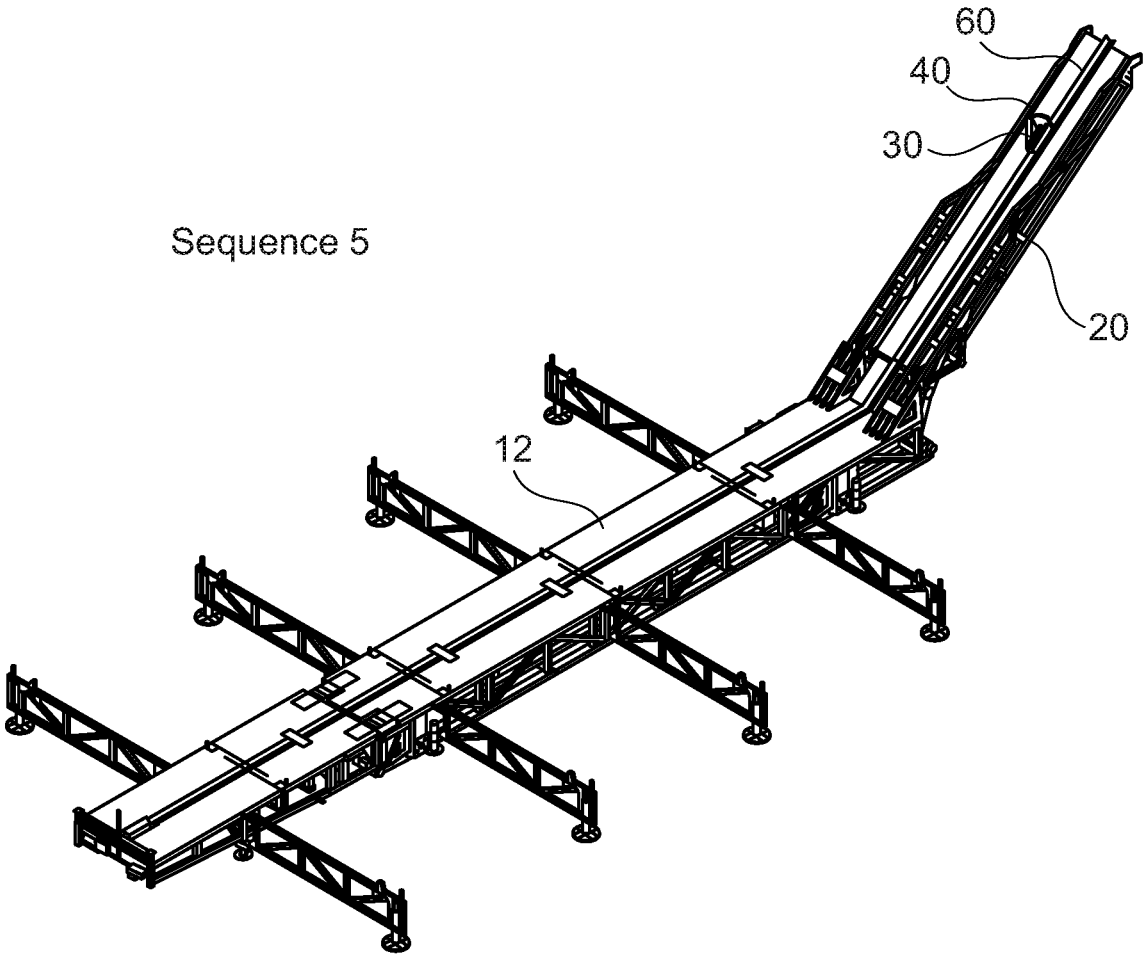
Figure 12:
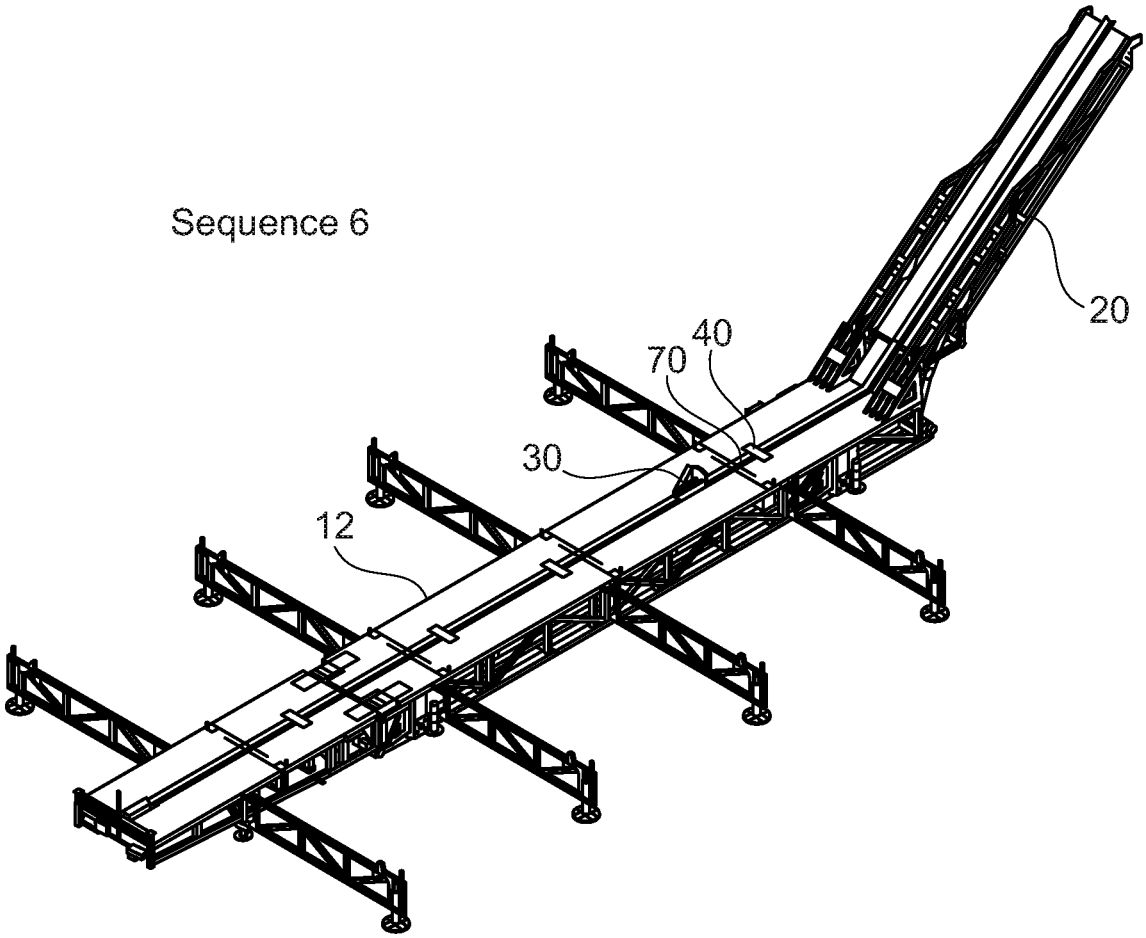

After the drill rod 3 has been drawn from the supply ramp 20, the rear sledge 30 is moved towards the front sledge 40, as is shown in sequence 5 of FIG. 11. After the rear sledge 30 has been pushed against the front sledge 40 and being connected together by the linking device 50, the front sledge 40 is disengaged from the stop and locking mechanism 60. Then the sledge arrangement is moved backwards by changing the moving direction of the drive rope. When passing the initial position of the front sledge 40 at the receiving bed 12, the linking device 50 is disengaged by a releasing mechanism 70 and the front sledge 40 separated from the rear sledge 30. The front sledge 40 is stopped at its initial position and awaiting a new drill rod 3 to be supplied, as is shown in sequence 6 of FIG. 12. The catch 43 is moved back in its projection position.

Figure 13:
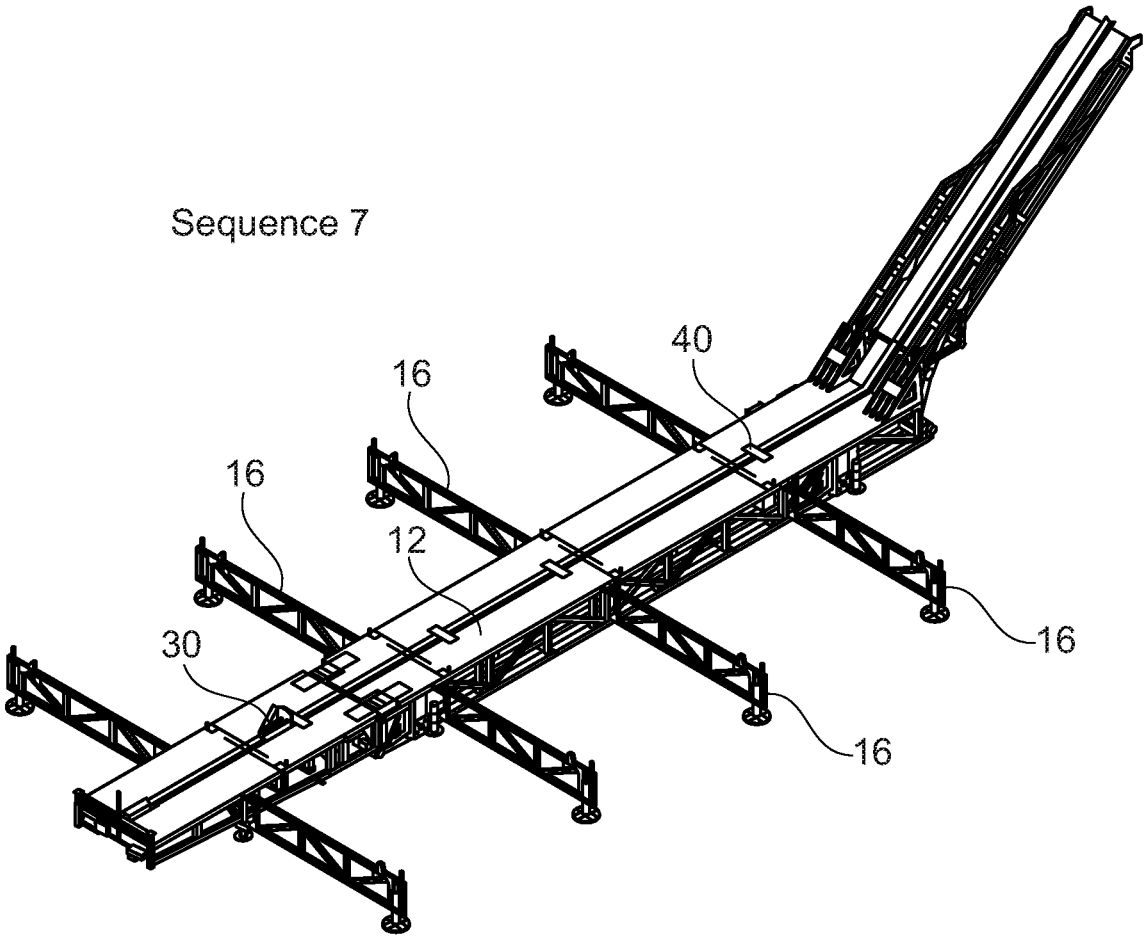

Finally, according to sequence 7 of FIG. 13, the rear sledge 30 is driven back to its initial position. At this position according to sequence 7, a new drill rod to be supplied can be transferred from the storing position on the support legs 16 onto the rear sledge 30 and the front sledge 40. After that, the process can again start with sequence 1.

Figure 14:
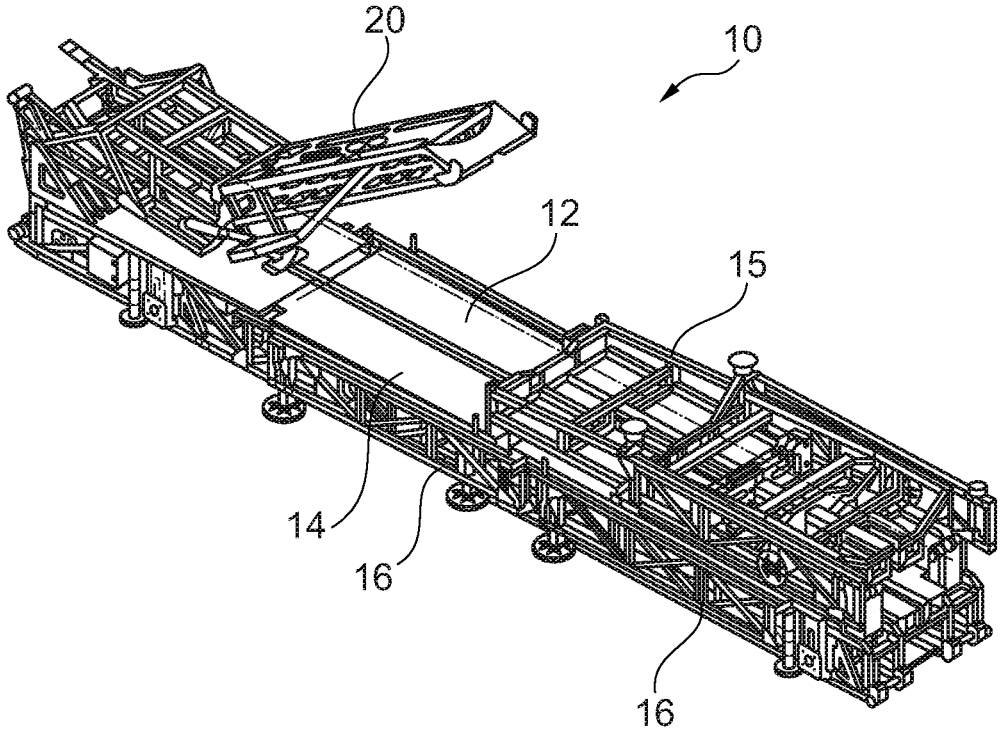
FIG. 14 a perspective view of the handling apparatus according to the invention in a partly folded state.

As shown in FIG. 14, the handling apparatus 10, according to the invention, can be folded together into a state of transportation. For transportation, the supply ramp 20 can be folded onto the upper side of the main part 14 of the receiving bed 12. In a similar way, the extension part 15 at the other end of the main part 14 is folded onto the main part 14 of the receiving bed 12. Furthermore, the support legs 16 are swung about vertical axes from their lateral extending position into their transport position, in which the support legs 16 are substantially parallel to the main part 14 of the receiving bed 12. Consequently, the handling apparatus 10 according to the invention can be folded into a compact size and can be efficiently transported.

The invention claimed is:

1. A handling apparatus for supplying drill rods to a drilling rig, comprising:

a track, which is adapted for receiving and supplying a drill rod or a casing to the drilling rig, the track including a receiving bed, which is substantially horizontally arranged, and a supply ramp configured to be arranged between the receiving bed and the drilling rig and inclined against the receiving bed, so that the drill rod or casing is configured to slide up along the supply ramp, a rear sledge, on which a rear end portion of the drill rod is mounted and which can be moved along the track by means of a sledge drive arrangement, and a front sledge, on which a front end portion of the drill rod is mounted and which can be moved along the track, wherein the rear sledge and the front sledge can be releasably connected to each other by means of a linking device, and the front sledge and the rear sledge are configured to move along each of the receiving bed and the inclined supply ramp.

2. The handling apparatus according to claim 1, wherein the rear sledge and the front sledge are released and distant from each other in an initial receiving position for receiving the drill rod or casing and when the rear sledge and the front sledge are moved to a transfer position at an upper end section of the supply ramp, and the rear sledge and the front sledge are connected by the linking device, when the rear sledge and the front sledge are moved from the upper end section back to the receiving position.

3. The handling apparatus according to claim 1, wherein a sledge drive arrangement comprises a drive rope, which is moved along the track, and the rear sledge comprises a coupling means, by which the rear sledge can be releasably coupled to the drive rope.

4. The handling apparatus according to claim 1, wherein at the upper end section of the supply ramp, a stop and locking mechanism is provided, by which the front sledge is stopped and locked when reaching the stop and locking mechanism.

5. The handling apparatus according to claim 4, wherein the front sledge is released from the stop and locking mechanism, when the rear sledge reaches the front sledge at the upper end section of the supply ramp and the front sledge is connected to the rear sledge by the linking device.

6. The handling apparatus according to claim 1, wherein the supply ramp is pivotably mounted on the receiving bed.

7. A method for supplying drill rods or casings by a handling apparatus to a substantially vertical drilling rig, the method comprising the steps of:

receiving a drill rod or casing in a substantially horizontal position on a track, the track including a receiving bed, which is substantially horizontally arranged, and a supply ramp configured to be arranged between the receiving bed and the drilling rig and inclined against the receiving bed, so that the drill rod or casing is configured to slide up along the supply ramp, positioning a rear end portion of the drill rod or casing on a rear sledge, which is movable along the track, and mounting a front end portion of the drill rod or casing on a front sledge, which is movable along the track, wherein the front sledge and the rear sledge move along each of the receiving bed and the inclined supply ramp, in moving the rear sledge and the front sledge are moved from a receiving position to a transfer position at an upper end section of the track supply ramp, the rear sledge and the front sledge are released and distant from each other, and moving the rear sledge and the front sledge from the transfer position back to the receiving position, the rear sledge and the front sledge are connected by a linking device.

8. The method according to claim 7, wherein when the front sledge reaches a stop and locking mechanism at the upper end section of the supply ramp, the front sledge is stopped and locked by the stop and locking mechanism.

9. The method according to claim 8, wherein when the rear sledge reaches the front sledge at the upper end section of the supply ramp and the front sledge is connected to the rear sledge by the linking device, the front sledge is released from the stop and locking mechanism.

10. The method according to claim 7, wherein in moving the front sledge and the rear sledge back from the upper end section of the supply ramp to the receiving position, the linking device is disengaged and the connection between the front sledge and the rear sledge is released at a determined position of the track.

* * * * *